United States Patent [19]

Phripp et al.

[11] 4,120,056

[45] Oct. 17, 1978

[54] FLUSH TOILET ACCESSORY

[76] Inventors: Clarence F. Phripp, R.R. #1, St. Clements, Ontario, Canada, N0B 2M0; Norman R. Preston, 169 Ross Ave., Kitchener, Ontario, Canada, N2A 1V5

[21] Appl. No.: 797,809

[22] Filed: May 11, 1977

Related U.S. Application Data

[63] Continuation-in-part of Ser. No. 615,923, Sep. 23, 1975, Pat. No. 4,032,997.

[30] Foreign Application Priority Data

Sep. 30, 1974 [GB] United Kingdom ..... 42437/74

[51] Int. Cl.[2] ..... E03D 1/14

[52] U.S. Cl. ..... 4/324; 4/325; 4/378

[58] Field of Search ..... 4/67 R, 67 A, 63, 57 R, 4/34, 37, 324, 325, 326

[56] References Cited

U.S. PATENT DOCUMENTS

| | | | |
|---|---|---|---|
| 847,361 | 3/1907 | Palmer et al. | 137/426 |
| 2,168,742 | 8/1939 | O'Neil et al. | 4/67 A |
| 2,773,268 | 12/1956 | Hurko et al. | 4/63 X |
| 3,003,156 | 10/1961 | Alexander | 4/63 X |
| 3,561,016 | 2/1971 | Reynolds | 4/57 R |
| 3,790,968 | 2/1974 | Pfeifer | 4/34 |
| 3,959,828 | 6/1976 | Acevedo | 4/34 X |

*Primary Examiner*—Henry K. Artis
*Attorney, Agent, or Firm*—Sim & McBurney

[57] ABSTRACT

This invention provides a flush regulator for use in a toilet flush tank, in order to regulate the outflow through the outlet pipe in such a way that less water is used per flush than normally is the case. The regulator includes a gripping means for attaching to the vertical stem which is screwed into the standard ball valve, and the gripping means supports two upright post members from which upwardly open cups are supported. The cup members are wholly to one side of their respective post members, and are positioned such that rotation of the regulator with respect to the bracket normally supporting the stem will bring one of the post members into contact with the bracket, rather than a cup member. By insuring that the cup members do not contact the bracket, interference with the intended vertical motion of the regulator, ball valve and stem is avoided.

9 Claims, 6 Drawing Figures

FLUSH TOILET ACCESSORY

This is a continuation-in-part of United States patent application Ser. No. 615,923, filed on Sept. 23, 1975, and entitled "FLUSH TOILET ACCESSORY" and now Pat. No. 4,032,997.

This invention relates generally to flush toilets, and has to do particularly with an accessory which may be applied to flush toilets incorporating valve-closed outlets, and which will reduce the amount of water used per flush.

Many flush toilet designs, particularly on the North American continent, have traditionally provided for a flushing operation in which, most of the time, considerably more water than the minimum necessary is utilized to evacuate the toilet bowl. This traditional design stems from an era in which water was readily and cheaply available in abundant supply.

Currently, however, certain densely populated areas and municipalities are experiencing shortages or curtailment of the water supply, accompanied by rising costs of supplying water, and it would be of advantage to provide some instrumentality by which new and existing flush toilets may be adapted to use a smaller amount of water to evacuate the toilet bowl.

To accomplish this objective in existing installations, particularly the older ones, it is necessary that such instrumentality be simply added to the installation without disassembly of the existing installation. It is a further requirement that certain water-wasting deficiencies be overcome, such as the sticking of the ball valve in the open position due to tilting and binding of the stem in the bore of the supporting bracket.

Despite the desirability of utilizing a smaller amount of water to evacuate the toilet bowl in normal use, however, it is occasionally of advantage to be able to employ the standard or full head of water for the flushing action which is provided by the original or traditional design of the reservoir tank.

This invention addresses itself to the foregoing disadvantages of conventional flush toilet design.

Accordingly, this invention provides a flush regulator for use in a toilet flush tank for regulating the outflow therefrom through an outlet pipe, the toilet flush tank including a hollow ball valve adapted to stop up the outlet pipe, a vertical stem with its lower end attached to the ball valve and its upper end adapted to be pulled up to initiate a flush, and a bracket extending laterally from an overflow pipe within the tank and having a vertical bore through which the stem passes, the regulator comprising: gripping means for gripping the vertical stem, two upright post members supported from the gripping means, the post members being spaced from the stem and from each other, and two upwardly open cup members capable of containing water mounted respectively to the post members, each cup member being wholly to one side of its respective post member and positioned such that rotation of the regulator in one direction with respect to the bracket will bring one of the post members into contact with the bracket, and rotation of the regulator in the other direction with respect to the bracket will bring the other post members into contact with the bracket, thereby preventing contact or catching of a cup member under or against the bracket.

One embodiment of this invention is shown in the accompanying drawings, in which like numerals denote like parts throughout the several views, and in which.

Figure 1:
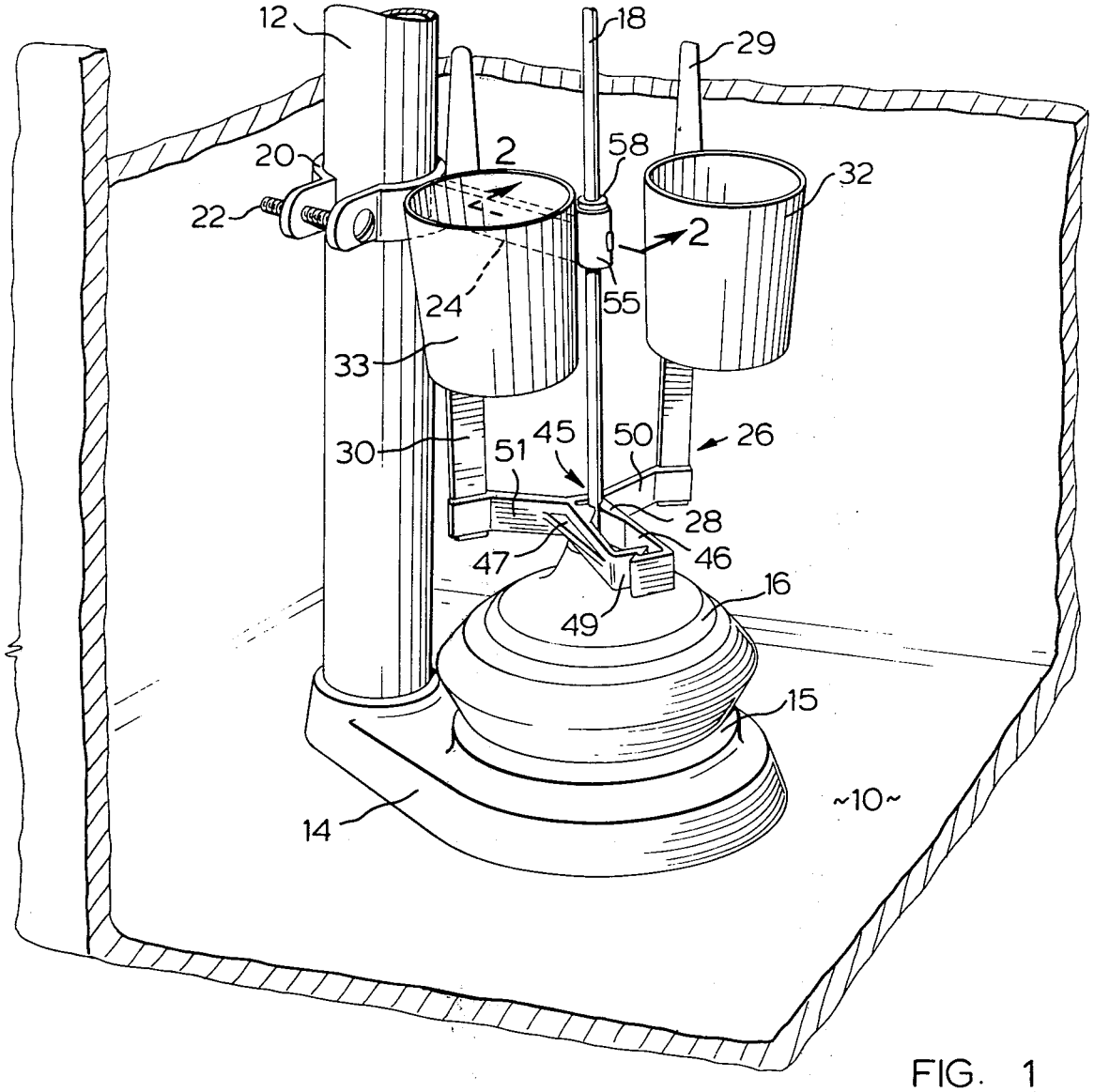
FIG. 1 is a perspective view of a toilet flush tank installation illustrating the use of the regulator of this invention.

Attention is first directed to FIG. 1 which illustrates a toilet flush tank 10 partly broken away to show the contents, the latter including an overflow stand pipe 12, a base fixture 14 which secures the overflow stand pipe 12 and which defines an upstanding circular lip 15 which represents the top of the outlet pipe through which flushing water passes during a flush. A standard hollow ball valve 16 which is filled with air and which has an opening at the bottom is adapted to close the outlet pipe defined by the lip 15 by seating thereon. A vertical stem 18 has its lower end threaded axially into the upper portion of the float valve 16, and has its upper end adapted to be pulled upwardly to initiate a flush (by connections not shown in FIG. 1).

A clamp 20 having tightening screws 22 is fastened around the overflow stand pipe 12 and supports a bracket 24 which extends laterally outward from the overflow stand pipe 12. The bracket 24 is seen in broken lines in FIG. 1, and is shown in solid lines in FIG. 5.

Figure 2:
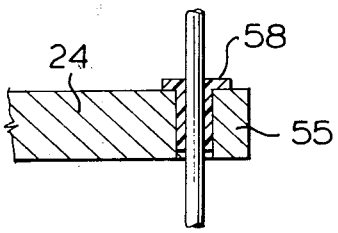
FIG. 2 is a sectional view taken along the line 2—2 in FIG. 1.

Shown in all figures except for FIG. 2 is a regulator 26 which includes, as general components, gripping means 28 adapted to grip the vertical stem 18, two upright post members 29 and 30 which are supported from the gripping means 28 and which are spaced both from the stem 18 and from each other, and two upwardly open cup members 32 and 33 mounted respectively to the post members 29 and 30.

Figure 5:
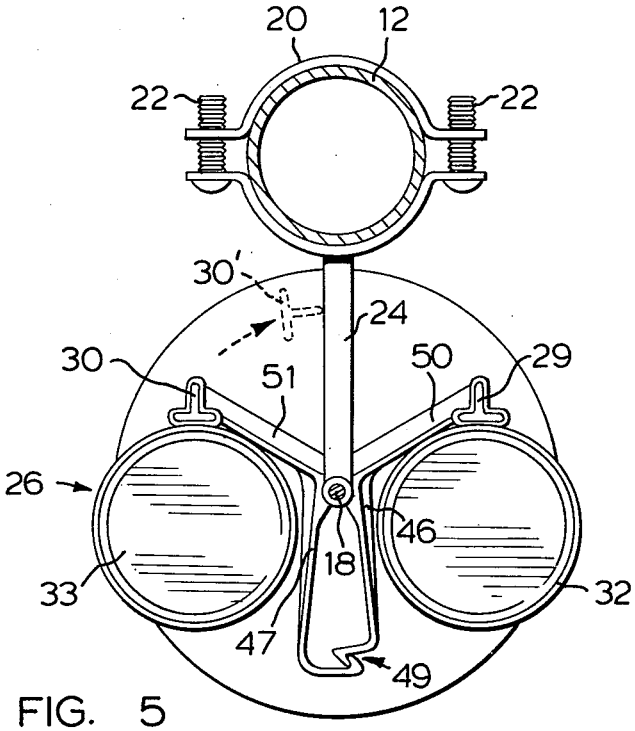
FIG. 5 is a horizontal sectional view taken along line 5—5 in FIG. 3.

As can be seen particularly in FIGS. 1 and 5, each cup member 32 and 33 is mounted wholly to one side of its respective post members 29 and 30. Moreover, as seen in FIG. 5, the cup members 32, 33 are positioned such that rotation of the regulator 26 with respect to the bracket 24 will bring one or the other of the post members 29, 30 into contact with the bracket 24, rather than one of the cup members 32, 33, and this will prevent contact or catching of a cup member 32, 33 under or against the bracket 24. Any such catching or contact would likely interfere with the proper functioning of the regulator and would prevent a full flush, as will be explained hereinafter. In FIG. 5, the dotted line representation 30' of the post member 30 is seen in contact with the bracket 24, and the particular construction of each post member 29, 30 is such that a smooth, unhindered upward movement of the post member is permitted, even if it is riding against the bracket 24.

Figure 6:
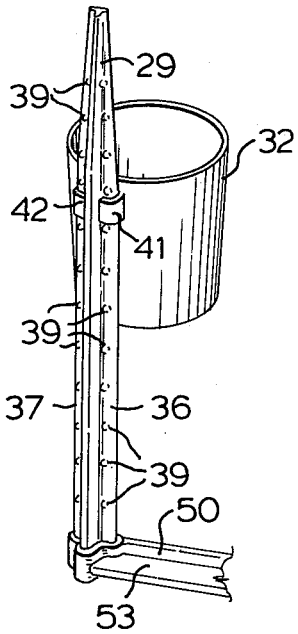
FIG. 6 is a perspective view of a part of the regulator.

More particularly, as is best seen in FIG. 5, each post member 29, 30 is T-shaped in horizontal section, the stem of the "T" being the portion which is adapted to contact the bracket 24 upon rotation of the regulator 26 (as seen in broken lines in FIG. 5). Each respective cup 32, 33 is mounted to the cross-member of the "T" and is adjustable in height with respect to the post member by virtue of structure which is best seen in FIG. 6. In FIG.

6 the post 29 is seen from "behind," in such a way that the clip connection between the cup member 32 and the post member 29 can be viewed.

The post member 29 is T-shaped in horizontal section, and each of the wings 36 and 37 of the cross-member of the "T" have a plurality of spaced-apart protrusions 39. The cup 32 has an integral C-shaped clip consisting of two portions 41 and 42 which grasp the two wings 36 and 37 of the cross-member of the "T," and secure the cup member 32 in position. The protrusions 39 are spaced apart sufficiently to allow a gap which can receive the members 41 and 42 of the C-shaped clip which is integral with the cup member 32. The portions 41 and 42 are somewhat resilient, so that the cup member 32 can be forcefully slid along the post member 29 to any selected location defined between an adjacent pair of protrusions 39. The purpose of this adjustability is to permit the user to select the amount of water released per flush, to suit the needs of a particular installation.

Turning now to the gripping means 28, this can be seen in the figures to include a pincer grip 45 having two jaws 46 and 47, the jaws 46 and 47 having a stepped, interlocking tooth grip as can be seen in FIGS. 1 and 5 at the numeral 49. The jaws 46 and 47 are integral at the far side of the stem 18 as pictured in FIG. 1, and each defines a portion adapted to bear against the stem 18 in a squeezing action when the jaws are snapped together with the teeth interlocking as shown in FIGS. 1 and 5. The provision of gripping means as shown permits ready assembly and disassembly of the regulator with respect to an existing toilet tank without requiring any part of the existing arrangement to be removed, adjusted or altered.

Also integral with each of the jaws 46 and 47 are two arm members 50 and 51 which extend away from their mutual connection at an angle (roughly 120°) from each other. At the distal ends of the arm members 50 and 51 (support arms), a T-shaped receiving slot is defined, which snugly receives the lower end of a respective post member 29, 30. This is best seen in FIG. 6. The arm members 50 and 51 are also T-shaped in cross-section, with the stem of the "T" being identified by the numeral 53 in FIG. 6. As can be seen in the Figures, by angling the arm members 50 and 51 in the manner described, with the cup members 32 and 33 both to the same side of the respective post members, the center of gravity of the combined cup members, the water contained in them, and the remaining portions of the regulator, falls in the region of the stem 18. This "balancing" with respect to the stem has the advantage of reducing to a minimum the risk of binding of the stem 18.

Many of the older flush toilet installations have, through prolonged use, developed a considerable slackness in the fit between the stem 18 and the portion 55 at the end of the bracket 24 through which the vertical bore passes. In other words, the vertical bore has become considerably larger in diameter than the diameter of the stem 18.

As will hereinafter appear, too great a slackness or looseness between the vertical bore in the portion 55 and the stem 18 could cause tipping over or tilting over of the valve stem 18 when the ball valve 16 has been raised clear of the lip 15, due to the fact that the buoyancy force of the ball valve is offset. The effect could be aggravated by the tilting of the cup members 32, 33 containing water. This tilting over under a moment arm induced by the ball valve alone or by the ball valve and the weight of water in the cup members 32 and 33, could cause binding between the stem 18 and the portion 55, and could inhibit the downward descent of the ball valve 16 to close the outlet pipe at a premature point. For this reason, it is of practical advantage to provide in such cases a sleeve 58 (FIG. 2) of low-friction plastic, adapted to slip into the vertical bore in the portion 55, and to snugly but slidably receive the stem 18 in such a way that the stem 18 is not allowed a great deal of angulation with respect to the portion 55 of the bracket 24. The insert or sleeve 58 could be split (i.e., C-shaped in cross-section) to permit its insertion without having to unscrew the stem 18 from the ball valve 16.

Figure 3:
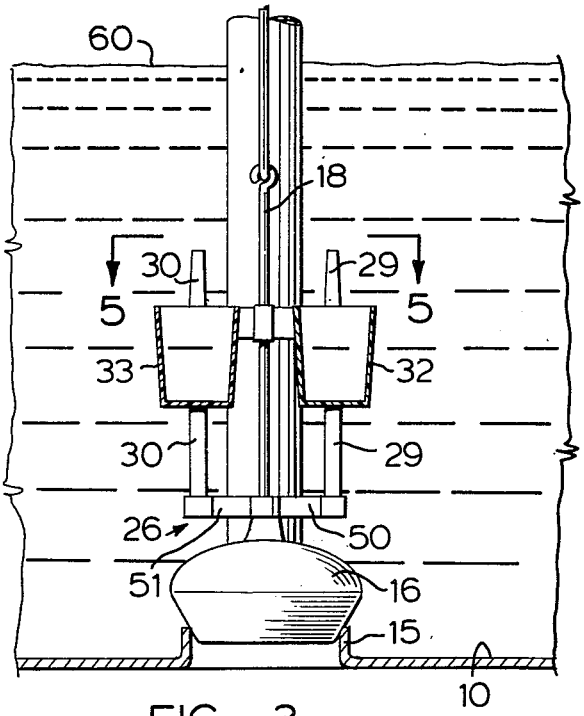
FIG. 3 is an elevational view of the arrangement of FIG. 1, partly in section, showing the arrangement just prior to flushing.
Figure 4:
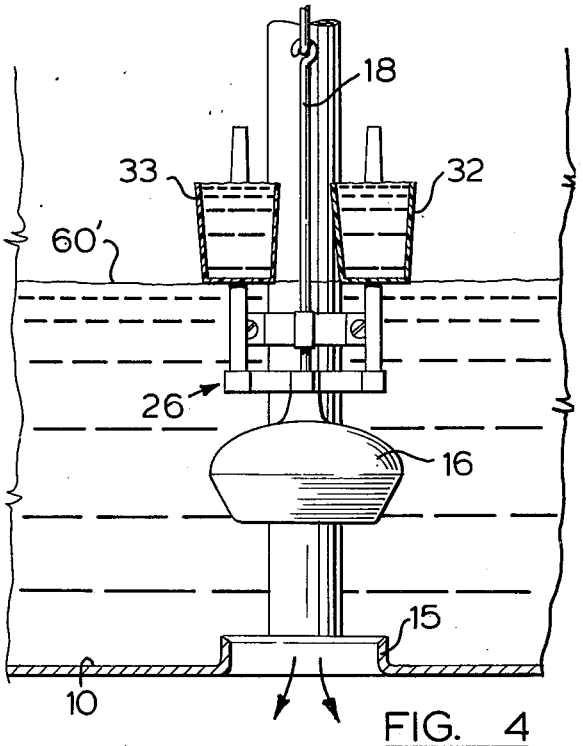
FIG. 4 is a view similar to that of FIG. 3, showing the arrangement partway through the flushing action.

Attention is now directed to FIGS. 3 and 4, with the help of which the operation of the regulator 26 will be described.

In the FIG. 3 condition, with the regulator 26 submerged and the tank 10 full of water up to the level marked 60, the cup members 32 and 33 are, of course, full of water, and the ball valve 16 is in place against the lip 15 thus preventing outflow of water from the tank 10. Upon flushing, upward force is exerted on the upper end of the stem 18 in the usual manner, and this will raise the stem and the ball valve 16 up to the position shown in FIG. 4. In this condition, the water contained in the tank 10 is able to flow out of the outlet pipe, and the level 60 drops to that shown at 60′ in FIG. 4. When the level has reached the level shown as 60′ in FIG. 4, the cup members 32 and 33 stand out of the water, such that the weight of the water contained in them exerts a strong downward push against the stem 18 and consequently against the ball valve 16. This additional weight of water in the cup members 32 and 33 pushes the ball valve 16 back down into seating relationship with the lip 15, thus arresting the outflow of water from the tank at a point earlier than that which is usually attained. (In conventional operation, the ball valve 16 remains in the uppermost position until the level of water in the tank reaches the ball valve itself, at which point the ball valve settles down with the air-water interface and finally seats against the lip 15 after virtually all the water in the tank 10 has passed outwardly through the outlet pipe).

It will be appreciated that the construction of the regulator is such that it may be attached to the stem 18 in an inverted position with the gripping jaws located above the bracket 24. In this condition the post members 29 and 30 would extend downwardly, but the cup members 32 and 33 could nonetheless be attached in the upright position. This mode of attachment could be utilized in installations where insufficient space is left between the ball valve 16 and the bracket 24.

What we claim is:

1. A flush regulator for use in a toilet flush tank for regulating the outflow therefrom through an outlet pipe, the toilet flush tank including a hollow ball valve adapted to stop up the outlet pipe, a vertical stem with its lower end attached to the ball valve and its upper end adapted to be pulled up to initiate a flush, and a bracket extending laterally from an overflow pipe within the tank and having a vertical bore through which the stem passes, the regulator comprising:

gripping means for gripping the vertical stem, two upright post members supported from said gripping means, the post members being spaced from the stem and from each other, and two upwardly open cup members capable of containing water mounted respectively to the post members, each cup member being wholly to one side of its respective post member and positioned such that rotation of the regulator in one direction with respect to the bracket will bring one of the post members into contact with the bracket, and rotation of the regulator in the other direction with respect to the bracket will bring the other post members into contact with the bracket, thereby preventing contact or catching of a cup member under or against the bracket.

2. The invention claimed in claim 1, in which the positions of the cup members are such that the regulator has its center of gravity close to the vertical stem, when the cup members are full of water.

3. The invention claimed in claim 1, in which each post member includes a portion adapted to contact the bracket upon rotation of the regulator, the respective cup member being mounted to the post member remote from said last-mentioned portion.

4. The invention claimed in claim 1, in which the post members are T-shaped in horizontal section, the stem of the "T" being adapted to contact the bracket upon rotation of the regulator, the respective cup member being mounted to the cross-member of the "T" and being adjustable in height with respect to the post member.

5. The invention claimed in claim 4, in which each post member has a plurality of spaced-apart protrusions so as to establish a plurality of specific vertical locations for the respective cup member.

6. The invention claimed in claim 1, in which the gripping means is in the form of a pincer grip which can be applied to the stem from the side without disassembly of the ball valve.

7. The invention claimed in claim 1, which further includes sleeve means for insertion into said vertical bore, the sleeve means providing a center passage which can snugly but slidably receive said stem.

8. The invention claimed in claim 6, in which the pincer grip has two interlocking jaw members extending in a first general direction away from a pincer location adapted to receive the stem, each of the post members extending from the end of a support arm which is integral with the gripping means, the support arms being disposed in such a way that, with both cup members supported from their respective post members in the same side and filled with water, the center of gravity of the regulator falls close to the position of the vertical stem.

9. The invention claimed in claim 1, in which each post member has a plurality of spaced-apart protrusions so as to establish a plurality of specific vertical locations for the respective cup member.

* * * * *